United States Patent [19]

Heintzelman

[11] 4,113,134

[45] Sep. 12, 1978

[54] CAN CLOSURE

[76] Inventor: Leo A. Heintzelman, 4990 Burlingame, Wyoming, Mich. 49509

[21] Appl. No.: 852,258

[22] Filed: Nov. 17, 1977

[51] Int. Cl.[2] ..... B65D 51/18

[52] U.S. Cl. ..... 220/256; 220/260; 220/281; 220/345; 220/336; 220/DIG. 19

[58] Field of Search ..... 220/256, 260, 265, 281, 220/345, 336, DIG. 19

[56] References Cited

U.S. PATENT DOCUMENTS

| | | | |
|---|---|---|---|
| 3,236,409 | 2/1966 | Cross et al. | 220/260 |
| 4,023,703 | 5/1977 | Strobe et al. | 220/345 |

*Primary Examiner*—George T. Hall

*Attorney, Agent, or Firm*—Sughrue, Rothwell, Mion, Zinn and Macpeak

[57] ABSTRACT

A container such as a beverage can has a flat top. An opening formed in the top has an inwardly reverted flange which prevents a sharp edge. The closure comprises an inside disc of a diameter greater than the diameter of the opening, and an outside button also of a diameter greater than that of the opening. The button has a raised dome like top, and the button and disc are joined by a narrow stem of a length such that both the button and disc tightly press against the can top and flange, respectively.

3 Claims, 6 Drawing Figures

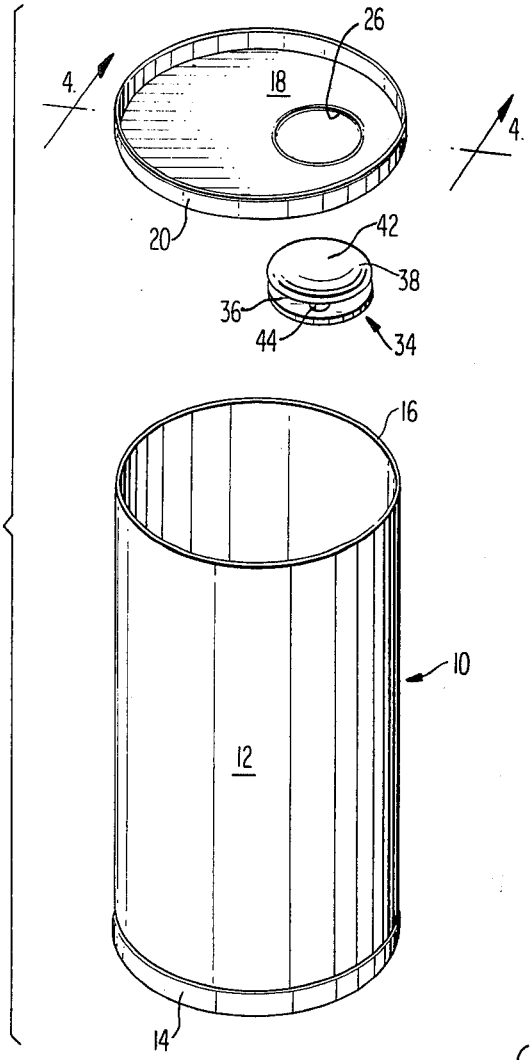
FIG 1
FIG 2
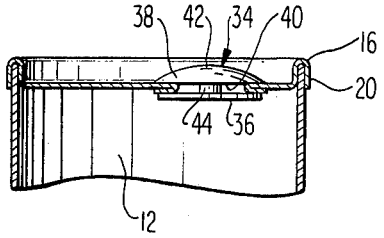
FIG 3
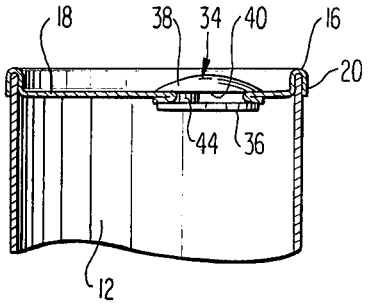
FIG 4
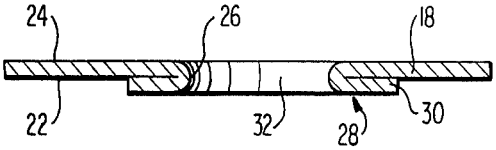
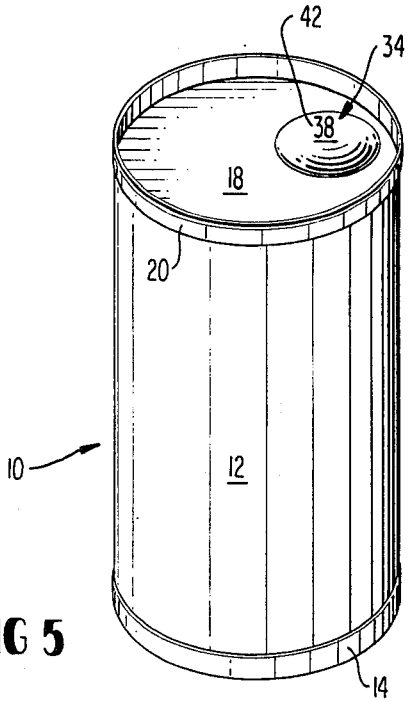
FIG 5
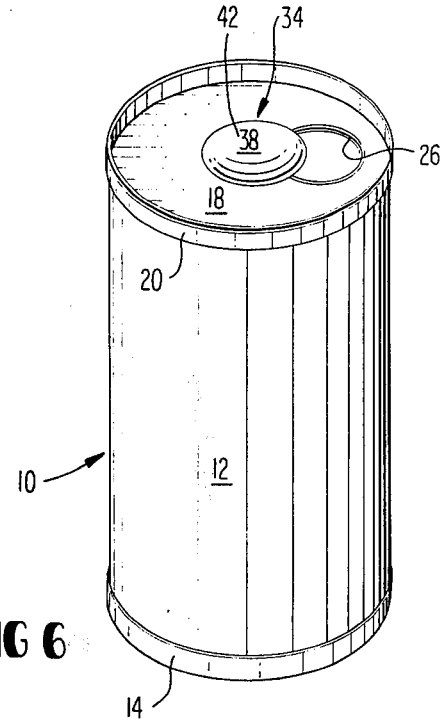
FIG 6

CAN CLOSURE

BACKGROUND OF THE INVENTION

1. Field of the Invention

This invention pertains to can type containers with reclosable top openings, and to the closure means therefore.

2. State of the Prior Art

It is heretofore known that beverage containers may be provided with auxiliary closing devices, and that openings in flat articles may be slidably closed. Representative patents in these fields include the following:

| Patentee | Reg. No. | Date |
|---|---|---|
| United Tool & Plastic, Inc. | British Pat. No. 1,123,646 | Aug. 14, 1968 |
| F. A. Griffin | 1,192,417 | July 25, 1916 |
| F. Lobl | 2,741,396 | April 10, 1956 |
| B. A. Sarafinas | 3,021,975 | Feb. 20, 1962 |
| C. J. Yates | 3,168,961 | Feb. 9, 1965 |
| R. B. Ganung | 3,289,881 | Dec. 6, 1966 |
| T. R. Kelley | 3,374,921 | March 26, 1968 |
| M. A. Rohrlick | 3,428,212 | Feb. 18, 1969 |

SUMMARY OF THE INVENTION

Beverages, including those of the carbonated variety are often sold in metallic containers. These cans require rupture of a component of the top, or piercing of the top itself in order to have access to the contents. This exposes the contents to ambient atmosphere, and if the contents are not consumed, the loss of carbonation often results in wastage. Various devices to preserve the contents of such containers when not expended upon initial opening have been heretofore proposed.

The present invention provides a can having an opening with an inwardly reverted flange which prevents the formation of a sharp edge upon opening. The can further has a closure comprising an inside disc of a diameter greater than that of the opening, an outside hand manipulable button, and a narrow stem connecting the disc and button.

The narrow stem permits maximum lateral movement of the closure to expose the opening for dispensing the contents while retaining the ability of the closure to be repositioned following partial utilization of the contents.

Other and further objects and advantages of the invention will become apparent to those skilled in the art from a consideration of the following specification when read in conjunction with the annexed drawing.

BRIEF DESCRIPTION OF THE DRAWING

FIG. 1 is a disassembled perspective view of a can embodying a closure according to this invention;

FIG. 2 is a medial cross sectional view showing the can top and showing the closure in sealing position;

FIG. 3 is a view similar to FIG. 2 showing the closure as displaced to open the container for access to the contents;

FIG. 4 is an enlarged sectional view on line 4—4 of FIG. 1, looking in the direction of the arrows;

FIG. 5 is a perspective view of an assembled can with the closure in closed position; and FIG. 6 is a view similar to FIG. 5 but showing the closure in open condition.

DESCRIPTION OF THE PREFERRED EMBODIMENT

In the sale of consumer items such as carbonated beverages including beer, soft drinks, and the like, containers which open by pulling or pushing on a rupturable portion of a can top are often employed. In the present invention, a conventional can 10 for beverages or the like has a tubular side wall 12 with a bottom 14 crimped at its rim thereto.

The can has a top edge 16 on which a substantially flat top 18 is fixedly secured by a crimped rim 20. In FIG. 4 it will be observed that the top has inner and outer surfaces 22, 24, respectively.

A circular opening 26 in the top 18 has a surrounding, internally directed flange 28 comprising a main portion 30 which is pressed substantially flush against the inner surface 22 of the top, and a rounded fold portion 32. The provision of the flange and its fold portion avoids the dangers incident to sharp edges often encountered in prior art cans. For purposes of description and orientation herein, the opening 36 is of a given diameter in the approximate proportion shown to the overall diameter of the can top. The can closure hereof is generally identified in the drawing by reference numeral 34. The closure 34 for the invention provides an effective seal for the opening, and is movable from its sealing position to an offset open position for access to the container contents. It may, following use of part of the contents, be reclosed.

The closure 34 includes a flat disc member 36 of a diameter at least greater than the aforesaid given diameter of the opening. A second component of the closure is an outer button member 38 which has a substantially flat lower face 40 and is of dome form at its top 42. A relatively narrow, substantially cylindrical stem 44 joins the disc member and the button lower face. The stem is of a length such that the button lower face is maintained in constant close frictional contact with the can top outer surface 24, and the disc member is maintained in the same relation to the main portion 30 of the flange.

Thus, it will be observed that the container may be opened by the application of pressure to the button dome surface 42 to slide it laterally to the side until the stem 44 comes into contact with the fold portion 32 of the flange. As seen in FIG. 6, this exposes a major portion of the opening 26 for dispensing of the can contents. If less than the entire contents is expended however the closure may then be returned to its sealing position (FIG. 2).

I claim:

1. In a can type container having a substantially flat top with inner and outer surfaces:

the top having a circular opening of a given diameter formed therein;

the opening having a surrounding, interior flange joined to the can top by an integral fold portion;

a can closure for opening and closing said opening comprising a disc member within the can, said disc member being of a diameter at least greater than the given diameter of the opening;

an outer button having a substantially flat lower face, and a dome form upper surface;

a narrow stem connecting the disc member and the lower face of the button; and said stem being of a length such that the button lower face is tightly frictionally engaged against the outer surface of can top, and the disc member is tightly frictionally engaged against the flange.

2. The invention of claim 1, wherein:

said disc member and said button are of the same diameter.

3. The invention of claim 1, wherein:

the can top has a rim; and the opening is located adjacent the rim.

* * * * *